United States Patent [19]

Pfefferkorn et al.

[11] 3,995,762

[45] Dec. 7, 1976

[54] BOTTLE STOPPER MEANS FOR WINE BOTTLES

[76] Inventors: Hans O. Pfefferkorn, Beehovenstr. 19, Simmern; Bernd Pfefferkorn, Gass 9, Kulz; Viktor H. Reiter, An der Schneiderburg, Simmern, all of Germany

[22] Filed: Mar. 24, 1976

[21] Appl. No.: 670,338

[52] U.S. Cl. ..... 215/256; 215/320

[51] Int. Cl.[2] ..... B65D 41/52

[58] Field of Search ..... 215/256, 320, 354

[56] References Cited

UNITED STATES PATENTS

| | | | |
|---|---|---|---|
| 3,109,547 | 11/1963 | Wood | 215/320 X |
| 3,684,118 | 8/1972 | Brumme | 215/320 X |
| 3,924,771 | 12/1975 | Cleff | 215/256 X |
| 3,944,103 | 3/1976 | Cros | 215/320 X |
| 3,946,891 | 3/1976 | Picoy | 215/320 X |

FOREIGN PATENTS OR APPLICATIONS

| | | | |
|---|---|---|---|
| 2,312,166 | 9/1974 | Germany | 215/320 |

*Primary Examiner*—Donald F. Norton
*Attorney, Agent, or Firm*—Erwin Salzer

[57] ABSTRACT

A tamper-proof bottle stopper intended to be used for closing wine bottles. The stopper means is of a composite nature and includes a stopper body having an integral upper flange portion which is situated in the closed position above the annular end surface of the neck of a bottle and abuts against the latter when the stopper body proper is pressed into the neck. The upper portion of the stopper body is corrugated or fluted on the radially outer surface thereof. The stopper body defines a cavity open at the upper end and closed at the lower end into which a gas-tight stopper insert is placed. The composite stopper means further includes a fluted cap that engages and coacts with the fluted portion of the stopper body so as to prevent a rotary motion of the cap relative to the stopper body. The cap is provided with a skirt projecting downwardly on the outer surface of the neck of a bottle. The cap, and more particularly its skirt, are of relatively small diameter and of a resilient material adapted to be expanded and mounted on a neck of relatively large diameter of a bottle and then to contract to said relatively small diameter. The cap includes a readily removable annular tearoff strap which, when torn off, severs the cap peripherally, and allows removal of the stopper body and of its insert from the neck of the bottle.

2 Claims, 2 Drawing Figures

BOTTLE STOPPER MEANS FOR WINE BOTTLES

BACKGROUND OF THE INVENTION

Wine bottles are generally closed by means of a cork or stopper, and by means of a cap of tinfoil or a plastic material (synthetic resin) mounted on the neck of the bottle and covering said cork or stopper. Such caps have two objects of which one is to improve the appearance of the bottle, and the other is to provide a means for detecting initial opening of the bottle, since it is fair to presume that the bottle has not been opened following an initial bottling operation if, and as long as, the aforementioned cap is intact.

Stoppers made of natural cork have severe limitations, as a result of which experimental work has been conducted to substitute synthetic elastomers for natural cork. The aforementioned limitations result from the fact that cork is a natural product which cannot be obtained in sufficiently uniform quality. Defective stoppers of natural cork tend to adversely affect the taste of wine in bottles closed with such stoppers. Wine bottles closed by stoppers of natural cork must always be maintained in a horizontal position, i.e. during storage in a cellar as well as in transit, since a stopper of natural cork provides a gas-tight seal only as long as it is wetted by the liquid contents of the bottle. The price of natural cork has always been subject to significant fluctuations, and its price is currently extremely high due to a shortage of natural cork and because of large increases in the cost of labor.

A drawback of the use of the combination of cork and cap used preponderantly for sealing or closing wine bottles is the fact that it requires several operational steps, namely that of inserting the cork into the neck of the bottle and the subsequent mounting of the cap thereon.

It is common practice to use stoppers of a synthetic elastomer for closing champagne bottles. Stoppers of a synthetic elastomer have not been used in the past to any appreciable extent in connection with wine bottles. The reason underlying this fact is that closing champagne bottles, on the one hand, and closing of wine bottles, on the other hand, are two very different problems. There is an excess pressure in champagne bottles and this calls for a special shaping of the stopper for a champagne bottle, a special design of its neck and presence of a wire cage, or metal strip, for maintaining the stopper inside of the neck of the bottle against the action of pressure therein, and also performing the function of indicating whether or not the bottle has previously been opened.

In the past a number of bottle stopper means have been evolved particularly intended for wine bottles.

It is the principal object of this invention to provide stoppers which are suitable to be used in connection with wine bottles, and which are not subject to the drawbacks and limitations of prior art devices of this description.

SUMMARY OF THE INVENTION

Stopper means embodying this invention include a stopper body of a synthetic flexible material adapted for insertion into the neck of a bottle so as to seal said neck. The stopper body has an upper integral annular flange portion of increased diameter fluted on the radially outer surface thereof. Said stopper body defines a cavity open at the upper end and closed at the lower end thereof. An elastomeric gas-tight stopper insert closely fitting the cavity of the stopper body is inserted into said cavity. Stopper means embodying this invention further include an outer cap being of relatively small diameter and of a resilient material adapted to be expanded and mounted on a neck of relatively large diameter of a bottle and then to contract to said relatively small diameter. Said outer cap forms a system of flutes engaging said upper fluted portion of said stopper body so as to preclude any rotary motion of said outer cap relative to said stopper body. Said outer cap further includes a readily removable substantially annular tear-off strap portion allowing to readily sever said outer cap in transverse direction to allow joint removal of said stopper body and of said stopper insert.

BRIEF DESCRIPTION OF THE DRAWING

The drawings illustrate a stopper embodying the present invention.

DESCRIPTION OF PREFERRED EMBODIMENT

Figure 2:
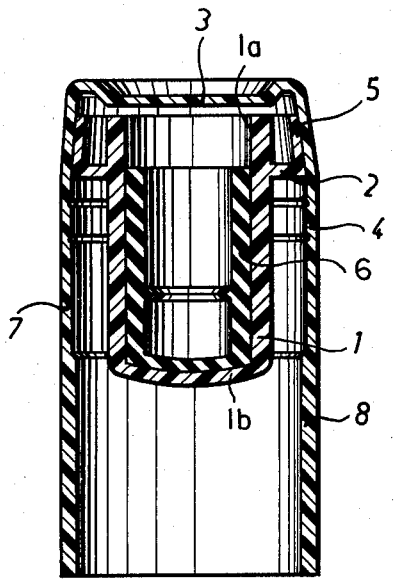
FIGS. 1 and 2 show some portions of the stopper in longitudinal section and other portions thereof in side elevation.

Referring now to the drawings, numeral 1 has been applied to indicate an elongated stopper body or stopper proper. Part 1 is closed at the bottom, i.e. toward the inside of the bottle and is intended to be inserted into the neck of the bottle and to fit tightly into said neck. The upper or axially outer end of stopper body 1 is provided with a portion 2 of larger diameter than stopper body 1 proper and forming an integral part thereof. Reference numeral 3 has been applied to indicate an outer cap mounted on the part 2 and having a sleeve portion 7 extending downwardly and intended to hug tightly the neck of a bottle.

The portion 2 integral with stopper body 1 is intended to rest upon, and to abut against, the end surface of the neck of the bottle. Portion 2 is fluted or grooved on its radially outer annular surface 5. A like system of flutes or grooves is formed by the outer cap 3 at the portion thereof adjacent its flat end surface. The fluted or grooved portions on parts 2 and 3 engage and prevent relative rotary motion of cap 3 and stopper body 1. Numeral 4 has been applied to indicate an annular strap portion of cap 3 forming part of its lateral surface and adapted to be torn off as a result of which the cap 3 is severed transversely. When strap 4 is torn off, stopper body 1 may be removed from the neck of a bottle into which it has been inserted by a rotary motion of the upper portion of cap 3 since the aforementioned co-engaging systems of flutes or corrugations preclude relative rotary movement between part 3 on the one hand, and part 1,2, on the other hand.

The stopper body 1 defines a cylindrical cavity **1*a* which is open at the upper end thereof and closed at the lower end thereof by a bottom portion 1*b*. An elastomeric gas-tight stopper insert 6 which closely fits cavity 1*a* is inserted into the latter. This composite stopper structure is called for because the synthetic flexible material of which stopper body 1 is made is not necessarily fully gas and particularly air tight, though it is impermeable to liquids. The stopper insert 6** protects the wine inside of the bottle from the outer atmosphere.

Another important feature of the invention consists in that the outer cap 3 is of relatively small diameter and of a resilient material adapted to be expanded and mounted on a neck of relatively large diameter of a bottle and then to contract approximately to said relatively small diameter it originally had, thus tightly hugging the neck of the bottle. Mounting of the composite bottle stopper means may be effected in one single operation by an appropriate mounting device.

It will be apparent that the cap 3 may be severed by tearing off the readily removable strip portion 4 to allow joint removal of stopper body 1, stopper insert 6, and the fluted portion of cap 3.

Figure 1:
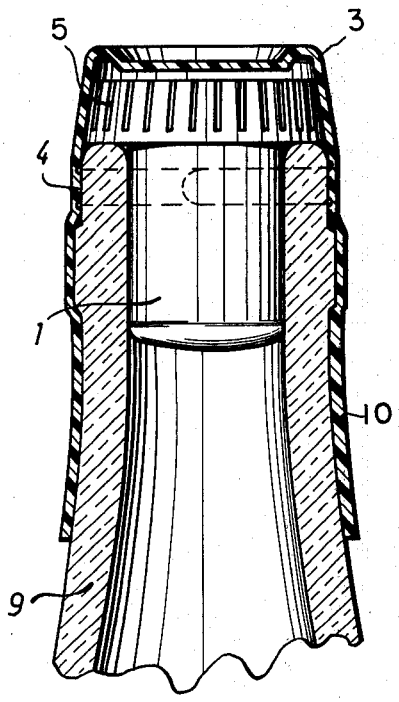

The wall thickness of cap 3 is not uniform. Cap 3 has a realtively small thickness at the region thereof immediately adjacent to stopper body 1 and has a relatively large thickness at the region thereof remote from stopper body 1. This has been clearly shown at 10 in FIG. 1 wherein numeral 9 has been applied to the neck of the bottle. The progressive increase of the thickness of cap 3 tends to assure its tight fit on the neck of the bottle and to achieve a higher degree of safety by precluding any opening of the bottle other than be tearing off strip 4.

We claim as our invention:

1. Stopper means for closing wine bottles and like receptacles including a. an elongated stopper body of synthetic flexible material adapted for insertion into the neck of a bottle so as to seal said neck;

b. said stopper body having an upper integral annular flange portion of increased diameter fluted on the radially outer surface and said stopper body further defining a cavity open at the upper end and closed at the lower end thereof;

c. an elastomeric gas-tight stopper insert placed into and closely fitting said cavity; and d. an outer cap engaging said upper portion of said stopper body, said outer cap being of relatively small diameter and of a resilient material adapted to be expanded and mounted on a neck of relatively large diameter of a bottle and then to contract to said relatively small diameter, said outer cap including a system of flutes engaging said fluted portion of said stopper body so as to preclude any rotary motion of said outer cap relative to said stopper body, and said outer cap further including a readily removable strap portion adapted to readily sever said outer cap in transverse direction to allow joint removal of said stopper body, said stopper insert, and said fluted portion of said cap.

2. Stopper means as specified in claim 1 wherein said outer cap has a relatively small thickness at the region thereof immediately adjacent said stopper body and a relatively large thickness at the region thereof remote from said stopper body.

* * * * *